US012540764B2

(12) United States Patent
Koester et al.

(10) Patent No.: US 12,540,764 B2
(45) Date of Patent: Feb. 3, 2026

(54) COMBINATION OF A REFRIGERANT ACCUMULATOR AND AN INTERNAL HEAT EXCHANGER FOR REFRIGERANT, CONNECTION COMPONENT, INTERNAL HEAT EXCHANGER AND ACCUMULATOR

(71) Applicant: Hanon Systems, Daejeon (KR)

(72) Inventors: Stephan Koester, Langerwehe (DE); Felix Girmscheid, Cologne (DE); Dominik Sernetz, Alpen (DE)

(73) Assignee: HANON SYSTEMS, Daejeon (KR)

( * ) Notice: Subject to any disclaimer, the term of this patent is extended or adjusted under 35 U.S.C. 154(b) by 85 days.

(21) Appl. No.: 18/247,683

(22) PCT Filed: Jan. 19, 2022

(86) PCT No.: PCT/KR2022/000952
§ 371 (c)(1),
(2) Date: Apr. 3, 2023

(87) PCT Pub. No.: WO2022/177177
PCT Pub. Date: Aug. 25, 2022

(65) Prior Publication Data

US 2023/0408157 A1 Dec. 21, 2023

(30) Foreign Application Priority Data

Feb. 17, 2021 (DE) ..... 10 2021 201 509.3

(51) Int. Cl.
*F25B 43/00* (2006.01)

(52) U.S. Cl.
CPC ..... *F25B 43/006* (2013.01); *F25B 2400/051* (2013.01)

(58) Field of Classification Search
CPC ..... F25B 43/006; F25B 2400/051; F25B 2400/054; F25B 40/00
See application file for complete search history.

(56) References Cited

U.S. PATENT DOCUMENTS

| | | | | |
|---|---|---|---|---|
| 4,316,434 A * | 2/1982 | Bailey | F24S 90/00 122/155.2 |
| 11,058,980 B2 | 7/2021 | Zapletal | |
| 2002/0078702 A1* | 6/2002 | Makizono | F28D 7/04 62/271 |
| 2009/0044563 A1* | 2/2009 | Heckt | F25B 43/006 62/503 |
| 2010/0155017 A1 | 6/2010 | Lemee et al. | |

(Continued)

FOREIGN PATENT DOCUMENTS

| | | | |
|---|---|---|---|
| CN | 101762131 A | 6/2010 | |
| CN | 101799232 B | 8/2014 | |
| CN | 102713474 B * | 5/2016 | F25B 41/04 |

(Continued)

*Primary Examiner* — Kun Kai Ma
(74) *Attorney, Agent, or Firm* — James D. Miller; Shumaker, Loop & Kendrick, LLP

(57) ABSTRACT

A combination of a refrigerant accumulator and an internal heat exchanger includes a central portion with fluid portions to which the accumulator and heat exchanger are attachable. A connection component includes at least four fluid ports, and components of a refrigerant circuit, in particular an accumulator and/or a heat exchanger, can be mounted thereto on at least two opposite sides.

11 Claims, 6 Drawing Sheets

(56) References Cited

U.S. PATENT DOCUMENTS

| | | | | |
|---|---|---|---|---|
| 2010/0155028 | A1 | 6/2010 | Lemee et al. | |
| 2020/0047098 | A1 * | 2/2020 | Zapletal | F25B 31/002 |

FOREIGN PATENT DOCUMENTS

| | | | | | |
|---|---|---|---|---|---|
| DE | 10348141 | B3 | * | 2/2005 | F25B 40/00 |
| DE | 102005059667 | A1 | * | 6/2007 | F25B 40/00 |
| DE | 19635454 | B4 | * | 6/2010 | F25B 40/00 |
| DE | 102006031197 | B4 | | 9/2012 | |
| DE | 102015003150 | A1 | * | 9/2016 | B60H 1/00342 |
| JP | 2004028525 | A | | 1/2004 | |
| JP | 2004156896 | A | | 6/2004 | |
| JP | 2010143574 | A | | 7/2010 | |
| JP | 5497419 | B2 | | 5/2014 | |
| KR | 20040003427 | A | * | 1/2004 | |
| KR | 20050082476 | A | | 8/2005 | |
| KR | 100784611 | B1 | * | 12/2007 | |
| KR | 1020100036789 | A | | 4/2010 | |
| KR | 101049696 | B1 | | 7/2011 | |
| KR | 20180056862 | A | * | 5/2018 | |
| KR | 101911264 | B1 | | 10/2018 | |
| WO | WO-2022177177 | A1 | * | 8/2022 | B60H 1/3229 |

* cited by examiner

COMBINATION OF A REFRIGERANT ACCUMULATOR AND AN INTERNAL HEAT EXCHANGER FOR REFRIGERANT, CONNECTION COMPONENT, INTERNAL HEAT EXCHANGER AND ACCUMULATOR

CROSS REFERENCE TO RELATED PATENT APPLICATIONS

This is a U.S. national phase patent application of PCT/KR2022/000952 filed Jan. 19, 2022 which claims the benefit of and priority to German Patent Application No. 10 2021 201 509.3 filed on Feb. 17, 2021, the entire contents of each of which are incorporated herein by reference.

TECHNICAL FIELD

The invention relates to a combination of a refrigerant accumulator and an internal heat exchanger for refrigerant, a connection component, an internal heat exchanger as well as an accumulator.

BACKGROUND ART

It is necessary to provide an internal heat exchanger in air conditioning systems for vehicles, especially when using modern refrigerants such as R744. The particular challenges here lie in limiting or preventing unwanted heat transfer from the heat exchanger to the storage area of the accumulator since this would compromise efficiency. Such combination components furthermore have a considerable longitudinal extension, which can lead to problems in respect of assembly and compatibility with restrictions regarding installation space. Finally, it is always necessary to be able to manufacture such components as cost-effectively as possible.

The cited combination components are known, for example, from US 2020 0047098 A1, DE 10 2006 031197 B4 and CN 000101799232 B.

Against this background, one object of the invention is to provide an efficient combination of a refrigerant accumulator and an internal heat exchanger that can be produced in a cost-effective manner.

SUMMARY

This object is solved by a central portion with fluid ports and two end portions, one of which is configured as an accumulator and one of which is configured as a heat exchanger. Individual components, in particular caps or cup-shaped portions, as will be described in more detail below, of the end portions may be attachable to the central portion, in particular may be welded thereto, which is possible in a particularly simple manner by means of a single fillet weld. The central portion in any case ensures that the two functions of accumulation and heat transfer are spatially separated from one another so that unwanted heat transfer, from the heat exchanger to the storage area of the accumulator, is significantly limited and efficiency is increased.

According to the invention, all fluid ports can furthermore be concentrated at the central portion so that only the central portion has to be worked in a suitable manner, for example by machining, which reduces manufacturing costs. In addition, the central portion may also comprise any fastening devices so that corresponding devices on the end portions are not necessary and these can be simplified. The central portion may advantageously be formed as a single piece.

The central portion may also be referred to as the central flange and may be formed in a particularly efficient manner as an extruded part. It may alternatively be formed as a cast part, in which case two halves of the central portion may be tapered by a few degrees for easy release from the mould. Fastening devices that are concentrated at the central portion furthermore simplify assembly.

Finally, the accumulator and the heat exchanger can each be configured independently of one another in terms of size.

The outer shell of the above-described combination component constitutes a pressure vessel, in the interior of which the pressure level of the accumulator part prevails and corresponds to the low pressure of the refrigerant circuit. In the idle state, the entire low-pressure-side volume of the accumulator and the internal heat exchanger serves as compensation volume for the refrigerant contained in the refrigerant circuit and prevents unallowably high idle pressures.

In order to compensate for refrigerant losses due to unavoidable leakages at the compressor shaft and circuit interfaces, there is usually slightly more refrigerant in the system (accumulator) than would be necessary for operation. The greater the amount of additional refrigerant, the longer the service interval for the air conditioning system. The amount that may be introduced as additional refrigerant in turn depends on the size of the compensation volume.

In the case of small pressure vessels, such as the combination component, efforts are made not to exceed a free internal volume of one liter in order to avoid special requirements of the Pressure Vessel Regulation. It is advantageously mentioned that below the one liter limit, the need for annual maintenance is avoided.

Combination components according to the prior art therefore never have more than one liter of free internal volume. The desire for more additional refrigerant or a longer service interval is subject to technical limitations here. A second pressure vessel having the sole purpose of serving as compensation volume contradicts all aspects of economy, cost, installation space and weight. Due to its design or architecture, the outer shell of the combination component according to the invention already constitutes a series connection of two pressure vessels such that a total of up to almost two liters of free volume can be made available as compensation volume for additional refrigerant, which, virtually without any significant extra effort, greatly increases flexibility with regard to meeting requirements on the part, for example, of automobile manufacturers. The accumulator part and the heat exchanger part constitute independent pressure vessels and are connected in series with one another by means of an internal tube connection (designated 28 in the drawings) instead of by means of external tubing. At the same time, both the accumulator and the heat exchanger each remain below a size of one liter.

It is preferred that at least one end portion comprises a one-piece cap or a one-piece cup. The caps or cups of both end portions may in particular have the same design so as to reduce part variety. This furthermore contributes to reducing costs since separate vessels for the described portions may be dispensed with.

In respect of the required pressure resistance, it is preferred that at least one cap or at least one cup comprises a hemispherical or hemiellipsoidal portion.

The number of individual parts can furthermore be reduced in an advantageous and cost-saving manner in that the central portion further comprises the cyclone for separating the liquid phase from the gas phase at the inlet of the accumulator.

For reasons of efficiency during manufacturing and for ease of assembly, it is, as already mentioned above, preferred for the central portion to furthermore comprise at least one fastening device.

This may be accommodated in a particularly simple manner in an opening in the central portion.

A fluid port may furthermore be advantageously inclined relative to a longitudinal axis of the combination, for example in order to predetermine the flow direction for entry into the cyclone.

The fluid ports may be provided centrally on the central portion in the sense of a symmetrical design, but they may also be provided off-center or eccentrically should this be required by the installation situation.

In order to reduce unwanted heat transfer from the heat exchanger to the accumulator as much as possible, there are further advantages if the heat exchanger is arranged above the accumulator in the installed state.

The invention is furthermore manifested in the connection component formed by the above-described central portion, which comprises at least four fluid ports to which components of a refrigerant circuit can be mounted on at least two opposite sides. The central portion or the connection component may furthermore advantageously comprise at least one connection between the end portions or the components to be attached.

Finally, the invention also consists of an internal heat exchanger or refrigerant accumulator that is mountable such that fluid ports are directed to a further component, such as an accumulator or internal heat exchanger, and not, as is common in the prior art with separate components, to external lines. With regard to the combination component, this corresponds to the fact that the two components, i.e. the internal heat exchanger and the refrigerant accumulator, are provided on opposite sides of the central portion, which makes it possible to achieve the described advantages.

DESCRIPTION OF DRAWINGS

Embodiment examples of the invention will be explained in more detail below with reference to the drawings. The drawings show the following.

DESCRIPTION OF AN EMBODIMENT

Figure 1:
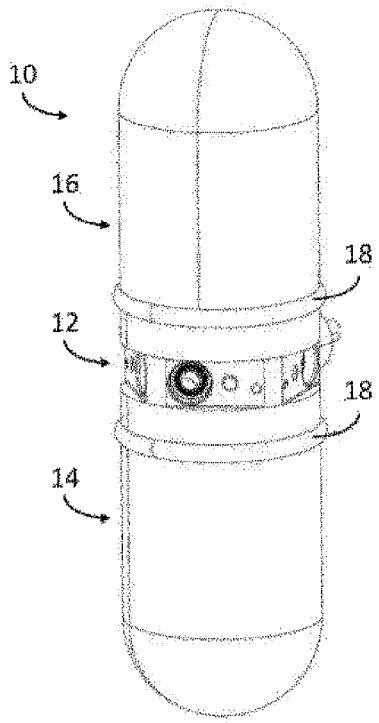
FIG. 1 shows a first embodiment in a perspective view.

As shown in FIG. 1, the combination 10 according to the invention substantially consists of a central portion 12, an accumulator 14 and an internal heat exchanger 16. Only the outer, cup-shaped vessels of the accumulator 14 and the internal heat exchanger 16, which have substantially hemispherical ends, are apparent in the perspective overall view of FIG. 1. In the shown case, these are shaped identically in order to reduce part variety and are each connected to the central portion 12 by means of a weld seam 18.

Figure 2:
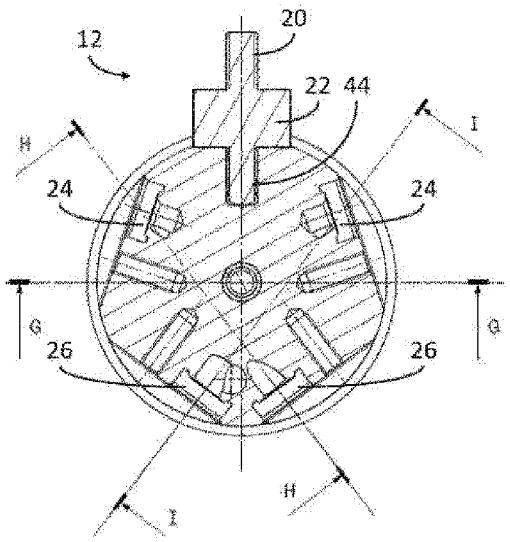
FIG. 2 shows a cross-section through the central portion of the embodiment shown in FIG. 1.

The fluid ports shown on the central portion 12 in FIG. 1 and the fastening device 20 can be seen in more detail in FIG. 2. The fastening device 20 may comprise a block 22 made of suitably soft material for damping, and may be inserted with a pin into a hole or opening 44 in the central portion 12. Two high-pressure ports 24 that lead to the heat exchanger 16 and two low-pressure ports 26 that lead to the accumulator are formed in the central portion 12, which is the only component that requires machining. The central portion 12 furthermore comprises a passage 28, which is central in this case, for connection between the heat exchanger 16 and the accumulator 14. As is apparent in FIG. 2, the central portion may be configured such that it is substantially cylindrical and may be provided with flat portions in those areas where fluid ports are provided, as can additionally be seen in FIG. 1.

Figure 3:
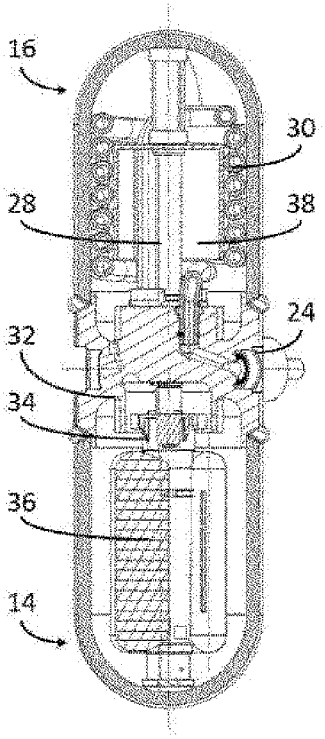
FIGS. 3 to 5 show various longitudinal sections through the embodiment shown in FIG. 1.

As is apparent in FIG. 3 for the high-pressure inlet 24, the line connecting this inlet to the spiral 30 of the heat exchanger 16, which is advantageously not configured as a separate tube but rather as an internal line in the form of a bore or channel, can be inclined relative to the longitudinal axis (vertical in FIGS. 1 and 3 to 5). The same applies to the high-pressure outlet 24.2, the low-pressure-side outlet (FIG. 3, center left) and furthermore to the supply channel to a low-pressure-side cyclone 32, which, as shown in FIG. 3, may advantageously be integrated into the central portion 12. Even though this is not shown, this channel may open out into the cyclone 32, in particular tangentially, so as to provide an advantageous flow direction in an efficient manner. Inclined channels can be produced with an acceptable amount of effort by means of machining and also offer the advantage that the central portion 12 can, as a result, be configured such that it is compact and lightweight. However, in particular if the central portion 12 is formed as an extruded part or cast, and thus ports that are raised relative to the cylindrical shell surface can be formed in an economical manner, the cited supply lines can also extend substantially perpendicular to the longitudinal axis.

Figure 4:
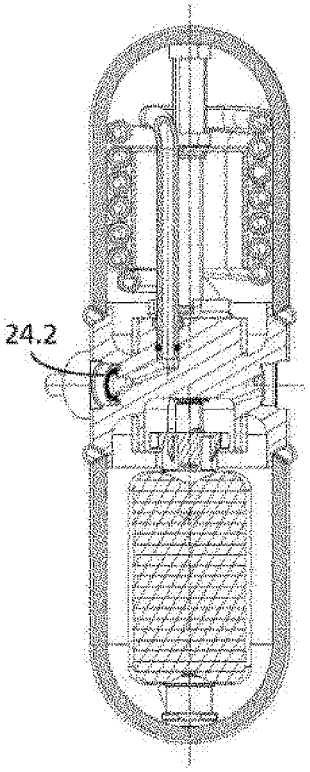

The accumulator 14 furthermore comprises a deflector 34, a container 36 for desiccant in the form of a non-woven bag, which may, however, also be located in the region of the heat exchanger 16, and a suction tube 40 that is not visible in FIGS. 3 and 4 but surrounds the central connection 28 and has an oil drain opening at the lower end. Liquid refrigerant drips through the annular gap between the deflector 34 and the outer wall of the cyclone 32 into the storage volume of accumulator 14. Gaseous refrigerant is sucked in through the annular gap between the central connection 28 and the suction tube 40 described below. The inlet is located at the upper side of the deflector 34. The gas phase first of all flows downwards in the described annular gap into the so-called sump of the accumulator, where it picks up and returns oil in doses through the so-called oil sniffing hole. The gas phase is then diverted together with the oil into the central connection 28 and, in accordance with the figures, flows upwards into the heat exchanger 16.

The connection 28 thus extends up into an upper region of the heat exchanger 16, in which the spiral 30 is located in the outer region and a flow guide 38 is located radially inwardly. The spiral 30 may be made of a substantially smooth tube, but preferably comprises radial ribs on the outside to increase efficiency. As regards the deflector, it is stated that it is not configured as a thin disk, as is common in the prior art, but rather forms an annular channel from top to bottom and not an annular gap. This prevents parts of the gas phase from entering the accumulator volume and stirring up the separated liquid therein. Reference is made in this regard to the application filed by the same applicant on 20 Nov. 2020, entitled "Deflector for Refrigerant Accumulator", the disclosure of which in this regard is made the subject matter of the present application. In order to save costs, a deflector configured as a flat disk may nevertheless also be used if the size or volume of the accumulator 14 of the present invention is sufficient, or a deflector may also be dispensed with entirely. It is furthermore mentioned that FIG. 3 corresponds to section I-I, FIG. 4 to section H-H and FIG. 5 to section G-G of FIG. 2.

The high-pressure outlet 24.2 and its inclined line in the direction of the spiral is accordingly apparent in FIG. 4. In all other respects, the illustration substantially corresponds to that of FIG. 3.

Figure 5:
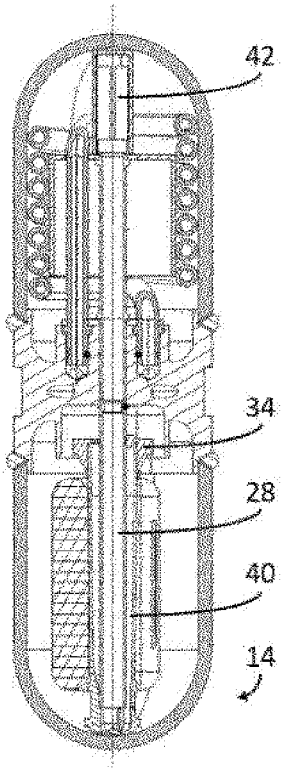

This similarly applies to FIG. 5, which additionally shows the connection 28 passing through all components as well as the outer suction tube 40 surrounding it in the region of the accumulator 14. It is also mentioned that O-rings may be provided for sealing in the region of the connections of the inlet and outlet of the spiral 30 as well as in the region of the continuous connection 28 with the central portion 12.

Figure 6:
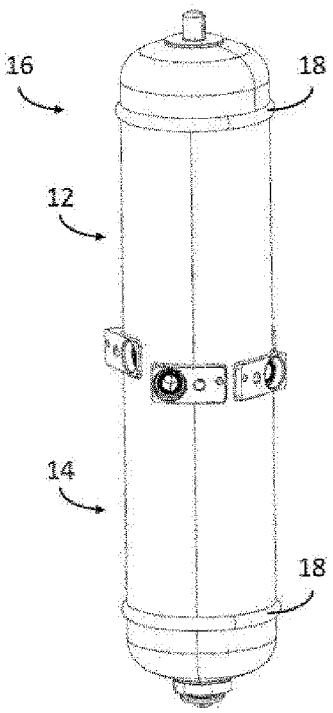
FIG. 6 shows a perspective view of a second embodiment.

The embodiment of FIG. 6 essentially differs from the embodiment described so far by means of a substantially elongated central portion 12, which leads to the pressure-tight sealing of the accumulator 14 and the heat exchanger 16 being provided by means of significantly shorter caps which are overall substantially hemispherical or ellipsoidal in shape and only have a comparatively short cylindrical portion directed towards the weld seam 18. The fluid ports are substantially identical to those shown in the preceding figures, but in the shown case are formed at different locations in the axial direction. As is additionally apparent in FIG. 6, further fastening devices, optionally with blocks made of soft material, may be provided at the upper and/or lower side.

Figure 7:
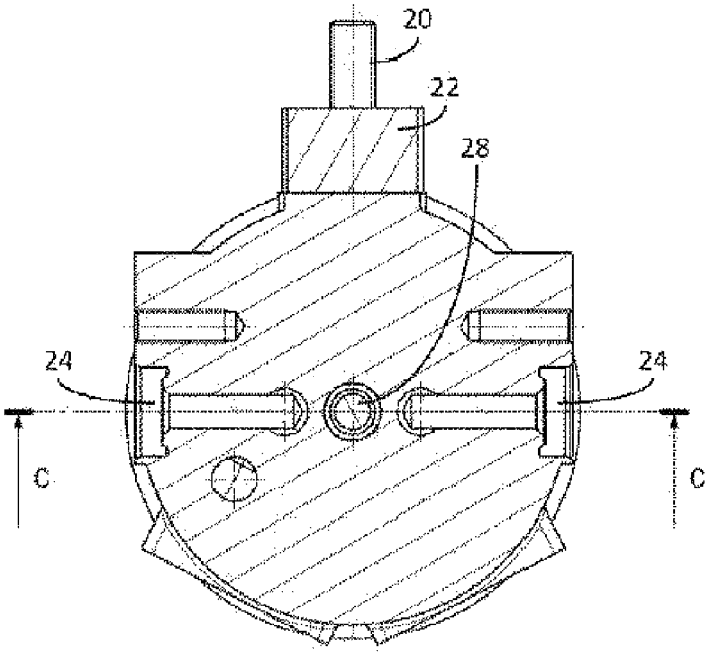
FIGS. 7 and 8 show various cross-sections through the embodiment shown in FIG. 6.

As is apparent in FIG. 7, the high-pressure ports 24 in the present case are in particular configured such that they are radially opposite one another and are offset slightly within the central portion in the direction of the heat exchanger 16, i.e. upwards according to FIG. 6.

Figure 8:
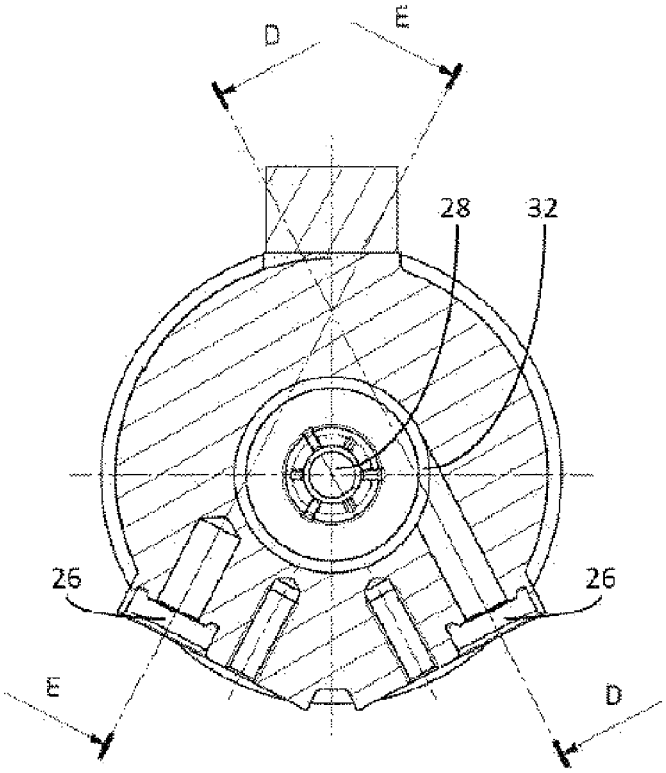

As is apparent in FIG. 8, the low-pressure ports 26 in the shown case are both formed in the lower half of the central portion according to FIG. 8. In particular the low-pressure inlet, on the right in FIG. 8, can be inclined downwards, i.e. in the direction of the cyclone that is apparent in FIG. 8. The tangential opening out into the cyclone 32 is furthermore apparent in FIG. 8. The central connection 28 can again be seen centrally in each of FIGS. 7 and 8.

In general, and since the holes, lines and channels extend predominantly orthogonal to the central axis, all four ports may be arranged at any angle to one another.

As is apparent in FIGS. 7 and 8, flat portions, which facilitate machining to form the fluid ports 24, 26, may extend from the outside of the cylindrical shape that forms the basic shape of the central portion 12, as is apparent in FIG. 6. It is furthermore mentioned that according to FIGS. 6 and 9 to 11, the fluid ports are provided substantially centrally on the central portion 12, but may also be arranged off-center.

Figure 9:
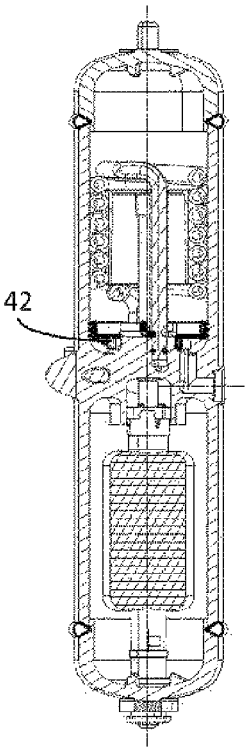
FIGS. 9 to 11 show various longitudinal sections through the embodiment shown in FIG. 6.
Figure 10:
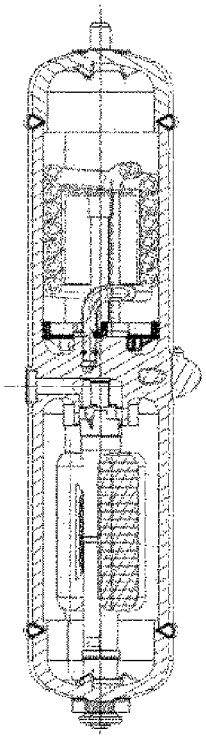
Figure 11:
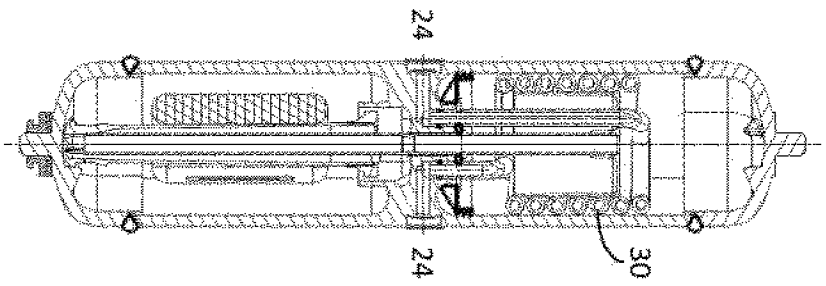

FIG. 9 corresponds to section E-E of FIG. 8, FIG. 10 to section D-D and FIG. 11 to section C-C of FIG. 7. The internal structure substantially corresponds to that of FIGS. 3 to 5, whereby owing to the specific configuration in FIG. 10, both connections between the high-pressure ports 24 and the spiral 30 are apparent.

A filter is also indicated by reference number 42 in the figures. The entire refrigerant and oil mass flow can hereby be filtered in an advantageous manner, and a separate filter at the oil sniffing hole can be dispensed with. Placement at the outlet (FIG. 9) can furthermore prevent the discharge of inherent contamination.

The invention claimed is:

1. A combination of a refrigerant accumulator and an internal heat exchanger, the combination comprising a central portion with fluid ports to which the refrigerant accumulator and the internal heat exchanger are attachable at opposite end portions, wherein the fluid ports are provided centrally on the central portion.

2. The combination according to claim 1, wherein at least one of the end portions comprises a one-piece cap or a one-piece cup.

3. The combination according to claim 2, wherein at least one cap or at least one cup comprises a hemispherical or hemiellipsoidal portion.

4. The combination according to claim 1, wherein the central portion further comprises a cyclone.

5. The combination according to claim 1, wherein the central portion further comprises at least one fastening device.

6. The combination according to claim 5, wherein the fastening device is accommodated in an opening in the central portion.

7. The combination according to claim 1, wherein at least one of the fluid ports is inclined relative to a longitudinal axis of the combination.

8. A combination of a refrigerant accumulator and an internal heat exchanger, the combination comprising a central portion with fluid ports to which the accumulator and the heat exchanger are attachable at opposite end portions, wherein at least one of the end portions comprises a one-piece cap or a one-piece cup.

9. A combination of a refrigerant accumulator and an internal heat exchanger, the combination comprising a central portion with fluid ports to which the accumulator and the heat exchanger are attachable at opposite end portions, wherein the central portion further comprises a cyclone.

10. A combination of a refrigerant accumulator and an internal heat exchanger, the combination comprising a central portion with fluid ports to which the accumulator and the heat exchanger are attachable at opposite end portions, wherein the central portion further comprises at least one fastening device.

11. A combination of a refrigerant accumulator and an internal heat exchanger, the combination comprising a central portion with fluid ports to which the accumulator and the heat exchanger are attachable at opposite end portions, wherein at least one fluid port is inclined relative to a longitudinal axis of the combination.

* * * * *